US008915495B2

(12) United States Patent
Jariabka et al.

(10) Patent No.: US 8,915,495 B2
(45) Date of Patent: Dec. 23, 2014

(54) MEDIA TRANSPORT

(75) Inventors: Keith Jariabka, Portland, OR (US); Kieran B Kelly, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 36 days.

(21) Appl. No.: 13/590,808

(22) Filed: Aug. 21, 2012

(65) Prior Publication Data

US 2014/0054846 A1 Feb. 27, 2014

(51) Int. Cl.
*B65H 3/06* (2006.01)

(52) U.S. Cl.
USPC ..... 271/117; 271/121; 271/226; 271/245

(58) Field of Classification Search
USPC ..... 271/114, 115, 117, 118, 121, 122, 226, 271/243, 244, 245, 246
See application file for complete search history.

(56) References Cited

U.S. PATENT DOCUMENTS 5,655,762 A * 8/1997 Yergenson ..... 271/121
5,720,477 A 2/1998 Morita et al.
6,199,855 B1 * 3/2001 Choeng et al. ..... 271/122
6,257,569 B1 7/2001 Rhodes et al.
6,354,586 B1 3/2002 Samoto
6,824,132 B2 * 11/2004 Asai et al. ..... 271/125
6,877,738 B2 * 4/2005 Sonoda et al. ..... 271/121
6,988,722 B2 1/2006 Su
7,303,189 B2 12/2007 Huang et al.
7,448,612 B2 11/2008 Rumford et al.
7,566,052 B2 * 7/2009 Hsu et al. ..... 271/121
7,641,187 B2 * 1/2010 Sonoda ..... 271/119
7,748,699 B2 * 7/2010 Nakashima ..... 271/122
8,020,985 B2 9/2011 Yoshida
8,104,885 B2 1/2012 Balcan
8,118,304 B1 * 2/2012 Chen et al. ..... 271/256
8,465,016 B2 * 6/2013 Winburne et al. ..... 271/117
2005/0018215 A1 1/2005 Ruhe et al.
2008/0061494 A1 * 3/2008 Chen ..... 271/117
2008/0179814 A1 7/2008 Sherman et al.
2011/0310156 A1 12/2011 Ramos et al.

* cited by examiner

*Primary Examiner* — Ernesto Suarez

(57) ABSTRACT

A media transport assembly includes a loadstop drive assembly to gather and compress a media stack in a media tray before a pick and feed cycle, and a pick drive assembly to pick a sheet of media from the media stack and feed the sheet of media to a media path. The loadstop drive assembly is positioned on one side of a gear wall and the pick drive assembly is positioned on an opposite side of the gear wall such that the pick drive assembly is driven by the loadstop drive assembly through the gear wall.

9 Claims, 16 Drawing Sheets

MEDIA TRANSPORT

CROSS-REFERENCE TO RELATED APPLICATIONS

This application is related to U.S. patent application Ser. No. 13/006,536 entitled "Media Stack Compression," filed on Jan. 14, 2011, the disclosure of which is incorporated herein by reference.

BACKGROUND

An inkjet printing system may include a print media transport assembly which moves and/or routes print media through a print media path, and a carriage assembly which moves a printhead relative to the print media. The print media transport assembly may perform steps of picking and loading a print media for printing, advancing the print media during printing, and ejecting the print media after printing as a sequence of serial steps. Performing such steps as a sequence of serial steps during a multi-page print job, however, results in an increased throughput time of the system as the sequence of serial steps are serially performed first for a first page, and then serially performed second for a second page.

BRIEF DESCRIPTION OF THE DRAWINGS

FIGS. 7A and 7B-16A and 16B illustrate various states of the transmission system of FIG. 4.

DETAILED DESCRIPTION

In the following detailed description, reference is made to the accompanying drawings which form a part hereof, and in which is shown by way of illustration specific examples in which the disclosure may be practiced. In this regard, directional terminology, such as "top," "bottom," "front," "back," "leading," "trailing," etc., is used with reference to the orientation of the Figure(s) being described. Because components of examples of the present disclosure can be positioned in a number of different orientations, the directional terminology is used for purposes of illustration and is in no way limiting. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Figure 1:
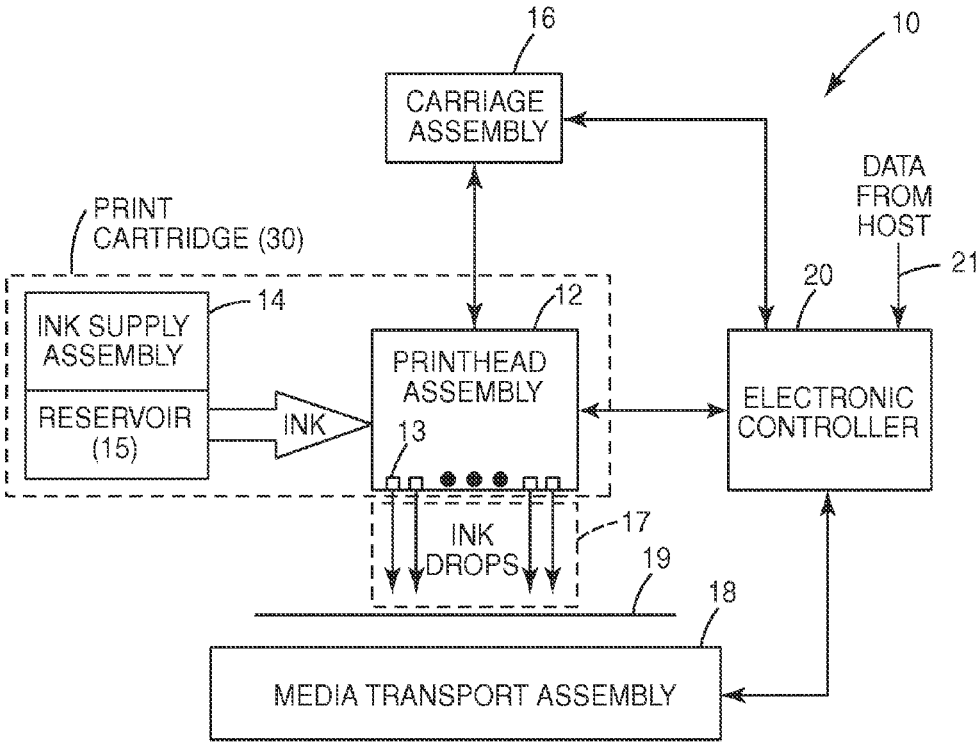
FIG. 1 is a block diagram illustrating one example of an inkjet printing system.

FIG. 1 illustrates one example of an inkjet printing system 10. Inkjet printing system 10 includes a fluid ejection assembly, such as printhead assembly 12, and a fluid supply assembly, such as ink supply assembly 14. In the illustrated example, inkjet printing system 10 also includes a carriage assembly 16, a media transport assembly 18, and an electronic controller 20.

Printhead assembly 12 includes one or more printheads or fluid ejection devices which eject drops of ink or fluid through a plurality of orifices or nozzles 13. In one example, the drops are directed toward a medium, such as print medium 19, so as to print onto print media 19. Print media 19 includes any type of suitable sheet material, such as paper, card stock, transparencies, Mylar, fabric, and the like. Typically, nozzles 13 are arranged in one or more columns or arrays such that properly sequenced ejection of ink from nozzles 13 causes characters, symbols, and/or other graphics or images to be printed upon print media 19 as printhead assembly 12 and print media 19 are moved relative to each other.

Ink supply assembly 14 supplies ink to printhead assembly 12 and includes a reservoir 15 for storing ink. As such, in one example, ink flows from reservoir 15 to printhead assembly 12. In one example, printhead assembly 12 and ink supply assembly 14 are housed together in an inkjet or fluid-jet print cartridge or pen, as identified by dashed line 30. In another example, ink supply assembly 14 is separate from printhead assembly 12 and supplies ink to printhead assembly 12 through an interface connection, such as a supply tube.

Carriage assembly 16 positions printhead assembly 12 relative to media transport assembly 18 and media transport assembly 18 positions print media 19 relative to printhead assembly 12. Thus, a print zone 17 is defined adjacent to nozzles 13 in an area between printhead assembly 12 and print media 19. In one example, printhead assembly 12 is a scanning type printhead assembly such that carriage assembly 16 moves printhead assembly 12 relative to media transport assembly 18. In another example, printhead assembly 12 is a non-scanning type printhead assembly such that carriage assembly 16 fixes printhead assembly 12 at a prescribed position relative to media transport assembly 18.

Electronic controller 20 communicates with printhead assembly 12, carriage assembly 16, and media transport assembly 18. Thus, in one example, when printhead assembly 12 is mounted in carriage assembly 16, electronic controller 20 and printhead assembly 12 communicate via carriage assembly 16.

Electronic controller 20 receives data 21 from a host system, such as a computer, and may include memory for temporarily storing data 21. Data 21 may be sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one example, electronic controller 20 provides control of printhead assembly 12 including timing control for ejection of ink drops from nozzles 13. As such, electronic controller 20 defines a pattern of ejected ink drops which form characters, symbols, and/or other graphics or images on print media 19. Timing control and, therefore, the pattern of ejected ink drops, is determined by the print job commands and/or command parameters. In one example, logic and drive circuitry forming a portion of electronic controller 20 is located on printhead assembly 12. In another example, logic and drive circuitry forming a portion of electronic controller 20 is located off printhead assembly 12.

Figure 2:
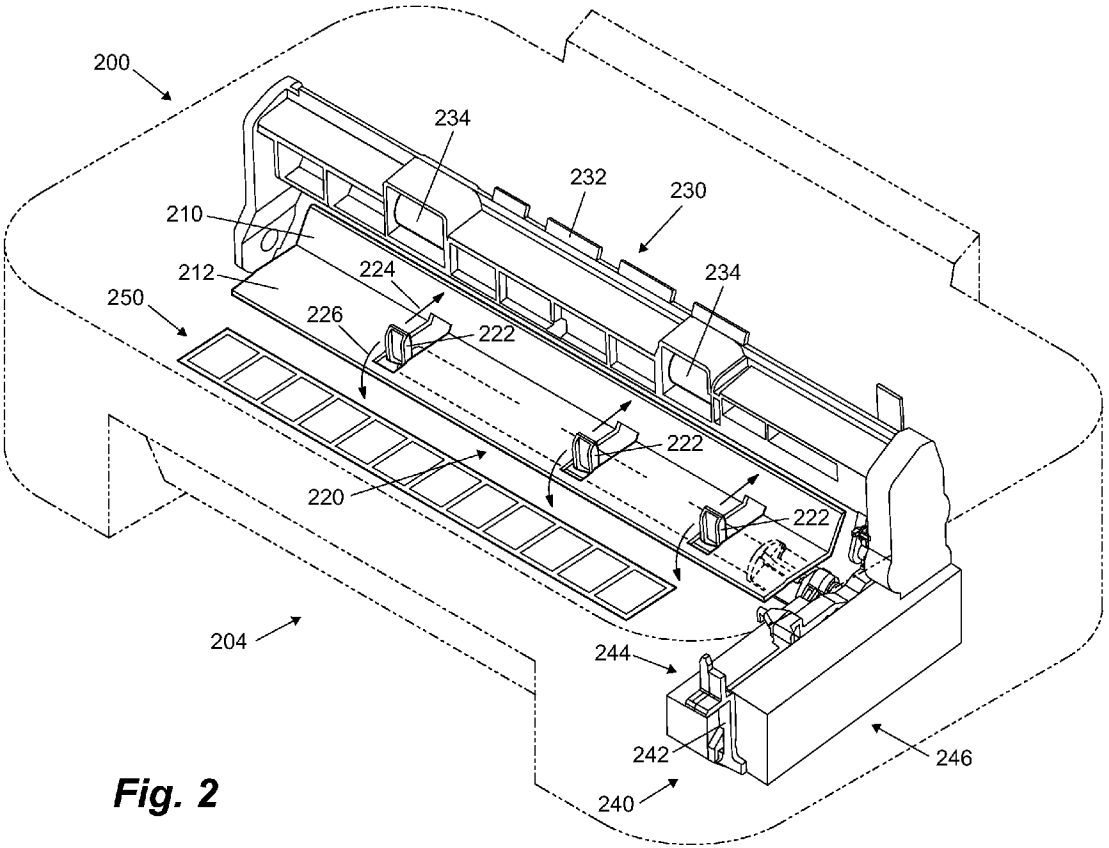
FIG. 2 is a schematic illustration of one example of a portion of a printing system.

FIG. 2 is a schematic illustration of one example of a portion of a printing system 200. In one implementation, printing system 200 includes a media tray (input tray) 210 for supporting a media stack, a media compression system 220 including a gathering loadstop assembly with one or more gathering loadstop levers or paddles 222 for gathering and compressing media in media tray 210, a pick mechanism 230 including a pick arm 232 and pick tires 234 for picking a sheet of media from the media stack, and a transmission system 240 for driving media compression system 220 and pick mechanism 230. The media stack is defined as an amount of media disposed within media tray 210. In one example, printing system 200 is a "top-in, front-out" printer, with media, such as paper, being loaded vertically in media tray 210 and fed through a print module 250 prior to being output through a front face 204 of printing system 200.

In the example illustrated in FIG. 2, three loadstop paddles 222 are disposed along a length of printing system 200. Loadstop paddles 222 may be disposed on a single axle and, consequently, configured to move in a synchronized manner. While three loadstop paddles 222 are illustrated, it is understood that more or fewer loadstop paddles 222 may be utilized.

As further described herein, loadstop paddles 222 are configured to transition between a plurality of positions including, for example, a "load" position, as an example of a first position, a "gather" position, as an example of a second position, and a "retract" position, as an example of a third position.

In the "load" position (illustrated in FIG. 2), a user may load media into media tray 210 such that loadstop paddles 222 function to prevent media from progressing into the media path or print module 250. In addition, loadstop paddles 222 also function to prevent a user from loading too much media into media tray 210, thereby preventing overloading of printing system 200.

In the "gather" position, loadstop paddles 222 are moved toward the media stack (i.e., toward media tray 210) to compress the media stack. The compression position may change depending on, for example, an amount of media in the media stack. For example, a compression position for a fully loaded media stack may be different than a compression position for a media stack with less than a full amount of media. In one implementation, loadstop paddles 222 arrive at the "gather" position by, for example, rotating toward media tray 210 as indicated by arrows 224.

In the "retract" position, loadstop paddles 222 are moved out of the media path, thereby allowing a picked media to enter print module 250. In one implementation, loadstop paddles 222 arrive at the "retract" position by, for example, rotating away from media tray 210, for example, by rotating under plate 212 as indicated by arrows 226.

In one implementation, loadstop paddles 222 arrive at the "gather" position during a transition from the "load" position to the "retract" position. For example, in transitioning from the "load" position to the "retract" position, loadstop paddles 222 may be rotated in the direction indicated by arrows 224 toward the media in media tray 210 before being rotated in the direction indicated by arrows 226 away from media tray 210. The movement toward media tray 210 may serve to gather and compress the media stack. The movement toward media tray 210 may be in response to rotation of a feedshaft in a first direction, and the movement away from media tray 210 may be in response to rotation of the feedshaft in a second direction.

In one example, transmission system 240 includes a gear wall (or support) 242, a first transmission assembly 244 disposed on a first side of gear wall 242, and a second transmission assembly 246 disposed on a second side of gear wall 242. As further described herein, first transmission assembly 244 is driven to operate media compression system 220, including actuation of loadstop paddles 222 to gather and compress the media stack, and second transmission assembly 246 is driven to operate pick mechanism 230, including actuation of pick arm 232 and rotation of pick tires 234 to pick and feed media from the media stack to the media path.

In one implementation, transmission system 240 is configured to move pick mechanism 230 from a "pick" position, where pick arm 232 applies a normal force to media in media tray 210, to a "lifted" position, where pick arm 232 is separated or lifted from contact with media in media tray 210. Separating pick mechanism 230 from the media stack may facilitate loading of additional media into media tray 210. The movement of pick mechanism 230 may be synchronized with the actuation of loadstop paddles 222. For example, when loadstop paddles 222 are in the "load" position, pick mechanism 230 may be moved to the "lifted" position. In addition, as loadstop paddles 222 transition to the "retract" position, pick mechanism 230 may be moved to the "pick" position.

Figures 3A, 3B, 3C:
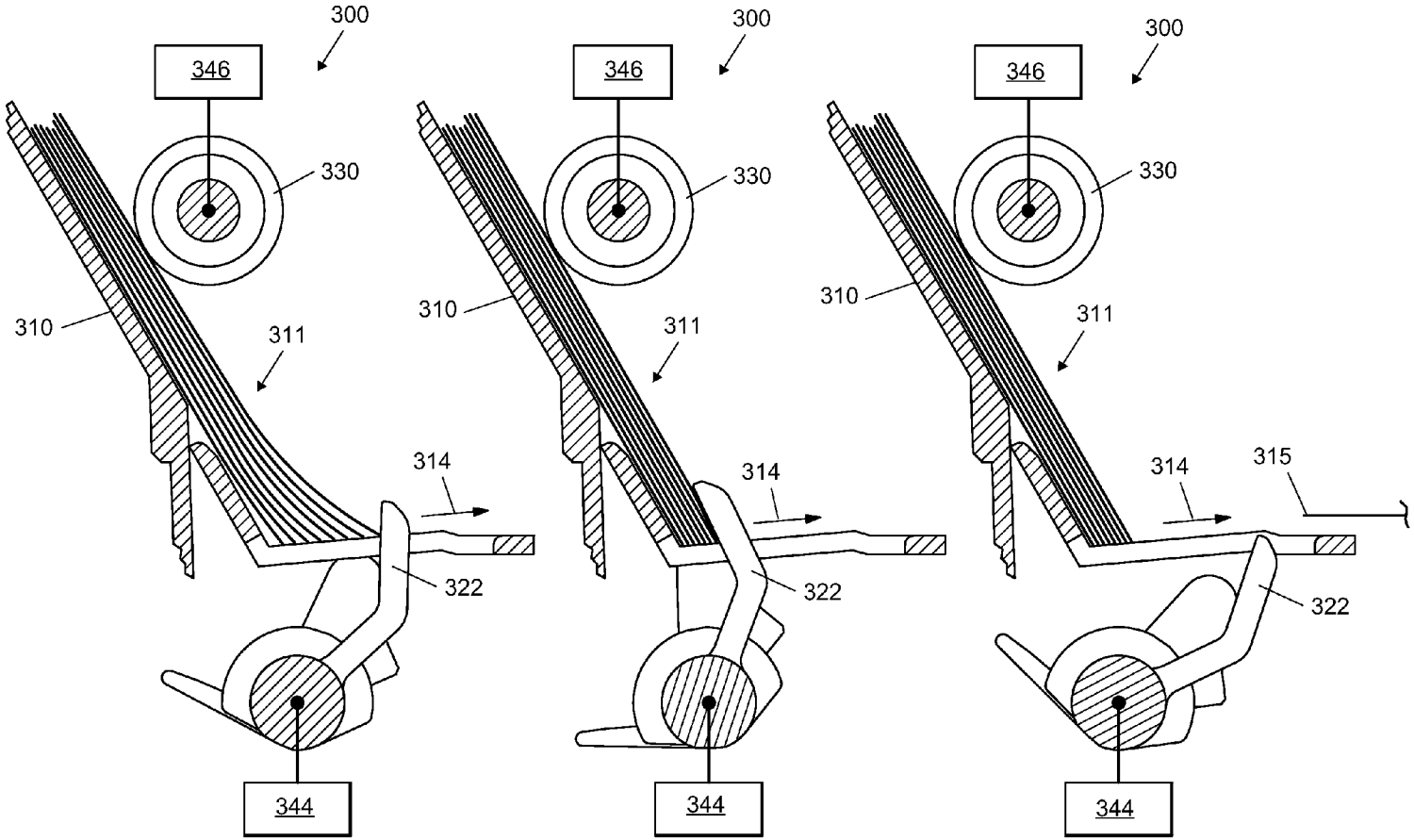
FIGS. 3A, 3B, and 3C schematically illustrate one example of a media compression system for a printing system.

FIGS. 3A, 3B, and 3C schematically illustrate one example of a media compression system 300 for a printing system, such as printing system 200. As further described herein, media compression system 300 includes a gathering loadstop assembly configured to compress and organize a media stack, with FIG. 3A illustrating system 300 in a first state, such as a disorganized state, FIG. 3B illustrating system 300 in a second state, such as a compressed state, and FIG. 3C illustrating system 300 in a third state, such as a retracted state.

In the illustrated example, system 300 includes a media tray (input tray) 310 supporting a media stack 311, a gathering loadstop lever or paddle 322, a pick mechanism 330, a first transmission assembly 344, and a second transmission assembly 346. In one implementation, media tray 310 is an upright media tray having an incline or slope. In other implementations, media tray 310 may be horizontal or include various other slopes. Media stack 311 includes media such as, but not limited to, paper.

Loadstop paddle 322 may be a load limiting mechanism configured to limit an amount of media loaded into system 300. In various implementations, loadstop paddle 322 may include a central axle on which multiple loadstop paddles are positioned. Pick mechanism 330 may include one or more elements configured to pick or select media in media stack 311, and may feed or move the media along media path 314. In one implementation, pick mechanism 330 may include one or more pick tires.

First transmission assembly 344 may be coupled to loadstop paddle 322 to move loadstop paddle 322 between a plurality of positions. For example, first transmission assembly 344 may be configured to move loadstop paddle 322 between a first position where loadstop paddle 322 serves to limit the amount of media that may be loaded into media tray 310, a second position where loadstop paddle 322 gathers and compresses media stack 311, and a third position where loadstop paddle 322 is out of media path 314.

Second transmission assembly 346 may be coupled to pick mechanism 330 to actuate pick mechanism 330 and move media in media stack 311 through media path 314. The movement of media through media path 314 may occur as first transmission assembly 344 transitions loadstop paddle 322 between the different positions. In one implementation, gathering of media in media stack 311 occurs while printing a prior-picked sheet (N). A trailing edge of the prior-picked sheet (N) is represented by 315. In addition, a subsequent sheet (N+1) is picked when the trailing edge of the prior sheet (N) leaves pick mechanism 330.

As illustrated in the example of FIG. 3A, system 300 is in a disorganized state. In the disorganized state, loadstop paddle 322 is in a "load" position and positioned in media path 314, thereby limiting the amount of media that may be loaded into media tray 310.

As illustrated in the example of FIG. 3B, system 300 is in a compressed state where loadstop paddle 322 has been moved to a "gather" position by first transmission assembly 344 to compress media stack 311. The compression serves to organize media stack 311. With media stack 311 in an organized manner, pick mechanism 330 may more accurately pick media. In the "gather" position, loadstop paddle 322 remains in media path 314.

As illustrated in the example of FIG. 3C, system 300 is in a retracted state. In one implementation, after being in the "gather" position, first transmission assembly 344 moves loadstop paddle 322 to the retracted state. In the retracted state, loadstop paddle 322 is in a "retract" position and moved out of media path 314, thereby allowing media to move through media path 314. In one implementation, second transmission assembly 346 may actuate pick mechanism 330 to pick or select media in media stack 311 as first transmission assembly 344 moves loadstop paddle 322 from the "gather" position to the "retract" position.

Figure 4:
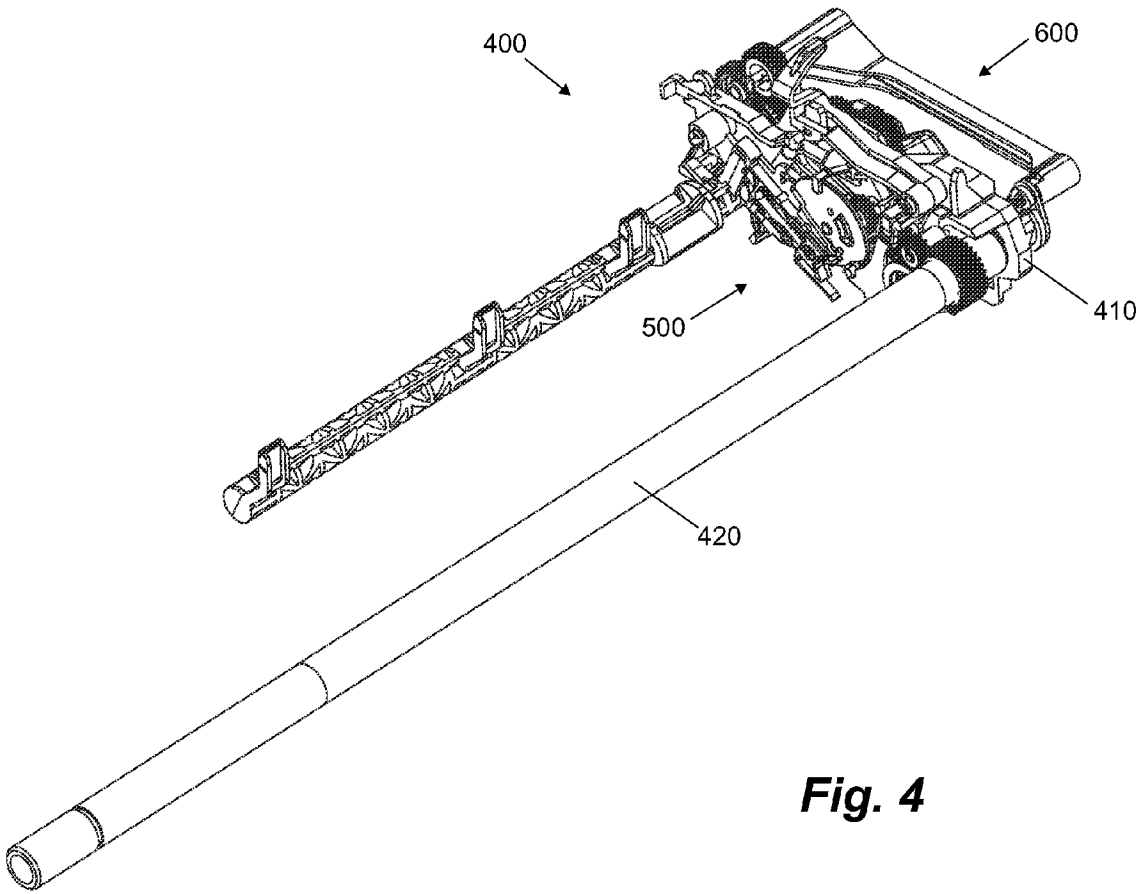
FIG. 4 illustrates one example of a portion of a transmission system for a printing system.

FIG. 4 illustrates one example of a portion of a transmission system 400 for a printing system, such as printing system 200. As described herein, transmission system 400 utilizes a combination of forward & reverse paper motor moves as well as carriage movement in order to, amongst other things, actuate a loadstop, pick and eject media, shift out of speedmech, and lift a pick arm assembly. In one example, transmission system 400 includes a first transmission assembly, referred to herein as loadstop drive assembly 500, and a second transmission assembly, referred to herein as pick drive assembly 600. In one implementation, loadstop drive assembly 500 is positioned on one side of a gear wall 410, and pick drive assembly 600 is positioned on an opposite side of gear wall 410.

In one implementation, loadstop drive assembly 500 and pick drive assembly 600 are driven, for example, by a feedshaft 420 to gather and compress a media stack, and to pick and feed media from the media stack to a media path. More specifically, loadstop drive assembly 500 and pick drive assembly 600 work in combination through built in mechanical timing and interaction with the carriage to produce a speedmech pick system with gathering loadstop actuation between pages (e.g., between every page) and a full media stack pick-arm lift.

Figure 5:
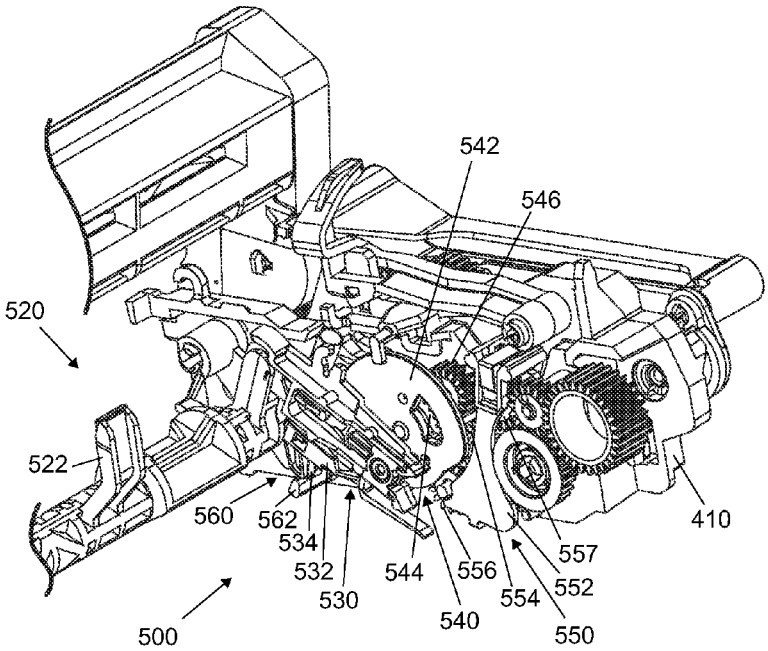
FIG. 5 illustrates one example of a first transmission assembly of the transmission system of FIG. 4.

FIG. 5 illustrates one implementation of loadstop drive assembly 500 as one example of a first transmission assembly of transmission system 400. Loadstop drive assembly 500 includes a gathering loadstop assembly 520, a loadstop link assembly 530, a cam gear assembly 540, a loadstop swingarm assembly 550, and a speedmech lock lever assembly 560. As further described herein, loadstop link assembly 530 is configured to move loadstop paddle 522 between a "load" position, a "retract" position, and a "gather" position between the "load" position and the "retract" position, cam gear assembly 540 is configured to actuate loadstop link assembly 530, and loadstop swingarm assembly 550 is configured to drive cam gear assembly 540.

In one example, gathering loadstop assembly 520 includes one or more gathering loadstop levers or paddles 522, loadstop link assembly 530 includes a loadstop link 532, a link base 534, and a link spring 536 (FIG. 7A), cam gear assembly 540 includes a cam 542, a cam gear 544, and an idler gear 546, loadstop swingarm assembly 550 includes a swingarm retainer 552, a central gear 554, and idler gears 556, 557, and speedmech lock lever assembly 560 includes a lock lever 562.

Figure 6:
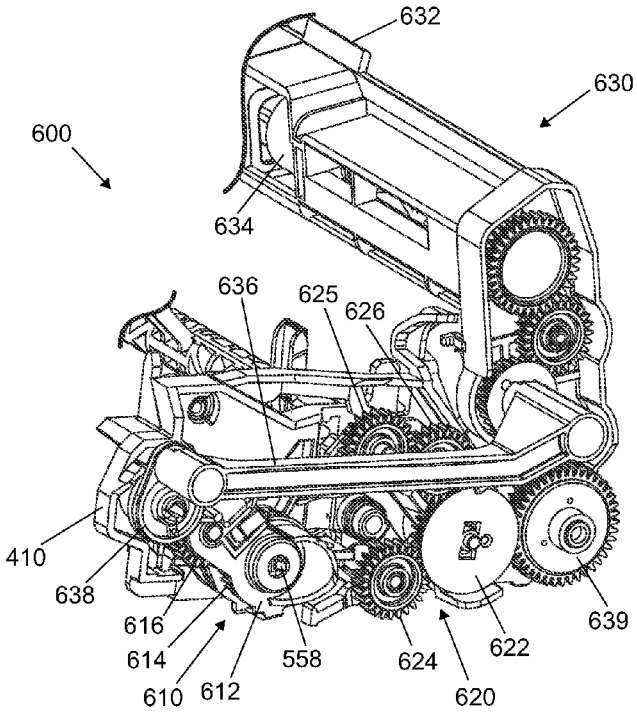
FIG. 6 illustrates one example of a second transmission assembly of the transmission system of FIG. 4.

In one implementation, as further described herein, idler gears 556, 557 of loadstop swingarm assembly 550 are selectively engaged with cam gear assembly 540 to drive cam gear assembly 540 in one direction with rotational input of a first direction and drive cam gear assembly 540 in the same one direction with rotational input of a second direction opposite the first direction. In addition, also as further described herein, loadstop link assembly 530 is configured to selectively engage (and disengage) speedmech lock lever assembly 560 to actuate (and un-actuate) speedmech lock lever assembly 560. In one implementation, rotation of central gear 554 of loadstop swingarm assembly 550 is transmitted through gear wall 410 such that central gear 554 provides rotational input to pick drive assembly 600 (FIG. 6). In addition, lock lever 562 of speedmech lock lever assembly 560 is selectively passed through gear wall 410 to "lock" (and unlock) speedmech swingarm assembly 620 of pick drive assembly 600.

FIG. 6 illustrates one implementation of pick drive assembly 600 as one example of a second transmission assembly of transmission system 400. Pick drive assembly 600 includes a pick swingarm assembly 610, a speedmech swingarm assembly 620, and a pick mechanism 630. As further described herein, pick mechanism 630 is configured to contact and pick a sheet of media from the media stack, pick swingarm assembly 610 is configured to actuate and drive pick mechanism 630, and speedmech swingarm assembly 620 is configured to drive pick mechanism 630 (with input from pick swingarm assembly 610).

More specifically, in one implementation, pick mechanism 630 includes a pick arm 632, pick tires 634, lifter link 636, lifter crank 638, and clutch assembly 639 such that pick swingarm assembly 610 is configured to actuate pick arm 632 of pick mechanism 630, and speedmech swingarm assembly 620 is configured to drive pick tires 634 of pick mechanism 630. In addition, lifter link 636 is configured to raise and lower pick arm 632 relative to the media stack, and lifter crank 638 is selectively engaged by a gear (idler gear 616) of pick swingarm assembly 610 to actuate lifter link 636.

In one example, pick swingarm assembly 610 includes a swingarm retainer 612, a central gear 614, and an idler gear 616, and speedmech swingarm assembly 620 includes a swingarm retainer (removed for ease of illustration and not shown), a pivot gear 622, and idler gears 624, 625, 626. In one implementation, as further described herein, idler gears 624, 625 of speedmech swingarm assembly 620 are selectively engaged with idler gear 616 of pick swingarm assembly 610 to drive pick tires 634 of pick mechanism 630 in one direction with rotational input of a first direction and drive pick tires 634 of pick mechanism 630 in the same one direction with rotational input of a second direction opposite the first direction. In addition, also as further described herein, speedmech swingarm assembly 620 is locked (and unlocked) by speedmech lock lever assembly 560 of loadstop drive assembly 500. In one implementation, a through-pin 558 of central gear 554 of loadstop swingarm assembly 550 (FIG. 5) passes through gear wall 410 such that rotation of central gear 554 of loadstop swingarm assembly 550 is transmitted to central gear 614 of pick swingarm assembly 610.

FIGS. 7A and 7B-16A and 16B illustrate various states of transmission system 400. More specifically, and with reference to the Transmission State Table presented below, FIGS. 7A and 7B-16A and 16B illustrate various states of transmission system 400, including loadstop drive assembly 500 and pick drive assembly 600, during a two-page print job.

Figure 7A:
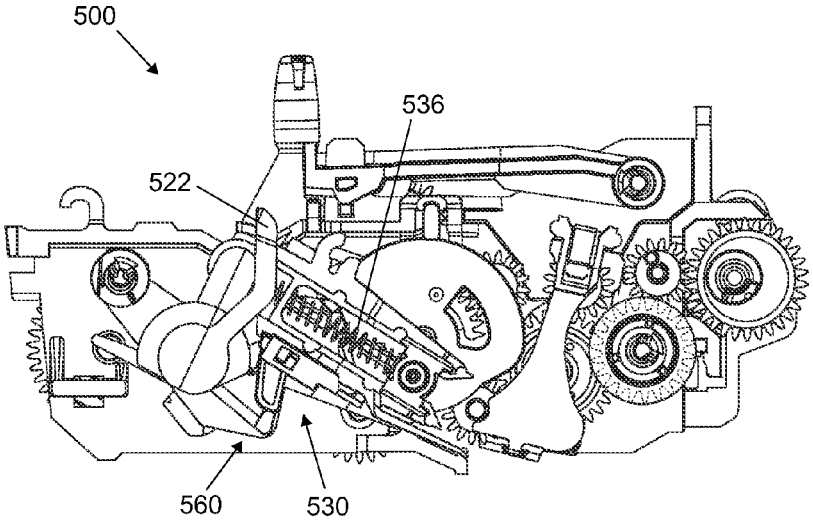
Figure 7B:
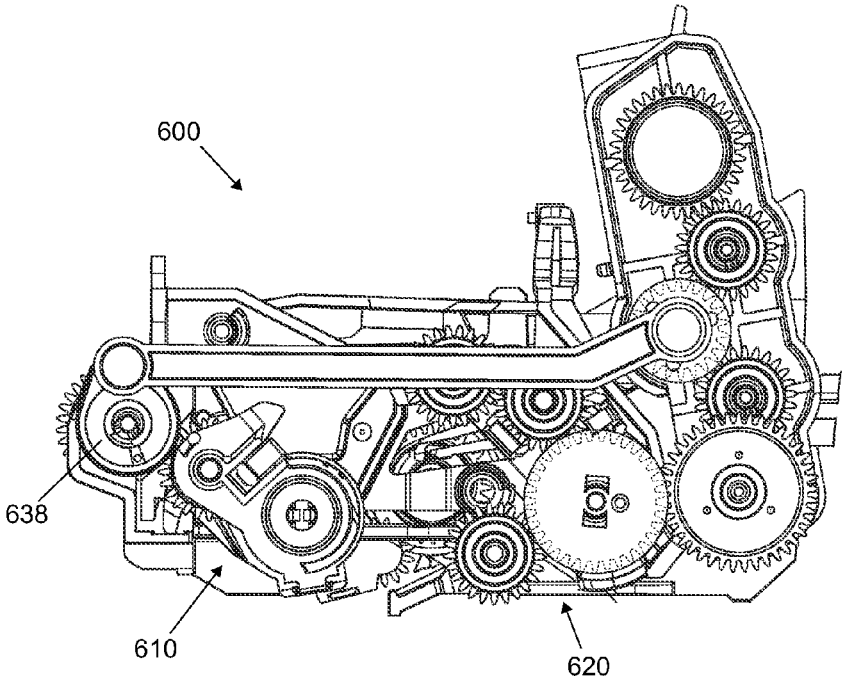

| | TRANS STATE | PICK DRIVE | LOADSTOP DRIVE | FEED DIR | CARRIAGE STATE | MEDIA STATE |
|---|---|---|---|---|---|---|
| PICK ARM LIFTED | Pick-Arm Lifted [FIGS. 7A and 7B] | Pick Swingarm Engaged with Lifter Crank in "Lifted" Position. Speedmech Swingarm "Unlocked". | Loadstop in "Load" Position. Loadstop Link Actuating Speedmech Lock Lever. | STATIC | CAPPED | Media Static in Input Tray. |
| PAGE 1 (LOAD, DESKEW & FEED) | Speedmech Pick Engaged [FIGS. 8A and 8B, 9A and 9B] | Pick Swingarm Passing Down Under Speedmech Swingarm to Engage with Idler Gear. | Loadstop Moving to "Gather" Position on its way to "Retract" Position. Speedmech Lock Lever Un-actuated by Loadstop Link. | FWD | IDLE | Media Static in Input Tray. |
| | | Pick Swingarm Engaged with Idler Gear and Driving Pick Tire. | Loadstop Static in "Retract" Position. | | | Media Page 1 Picked and Separated until Leading Edge Detection by OOPS (Out of Paper Sensor). |
| | Speedmech Paper Active Deskew [FIGS. 10A and 10B] | Pick Swingarm Reversing Up into Engagement with Speedmech Swingarm and Continuing to Drive Pick Tire. | Loadstop Moving to "Load" Position. Loadstop Link Actuating Speedmech Lock Lever. | REV | | Media Page 1 Deskewed at Pinch Rollers. |
| | Print and Pick Clutching [FIGS. 11A and 11B] | Pick Swingarm Passing Down and Engaged with Idler Gear. | Loadstop Moving to "Gather" Position on its way to "Retract" Position. Action Occurs Underneath Loaded Media. | FWD | PRINTING | Media Page 1 Printed Through Trailing Edge at Pick Tire. |
| PAGE 1 (FEED & EJECT) PAGE 2 (LOAD & DESKEW) | Speedmech Picking [FIGS. 12A and 12B] | Pick Swingarm Engaged with Idler Gear and Driving Pick Tire. | Loadstop Static in "Retract" Position. | | | Media Page 1 Printed to Completion. Media Page 2 Picked and Separated Until Leading Edge Detection by OOPS. |
| | Speedmech Paper Active Deskew [FIGS. 13A and 13B] | Pick Swingarm Reversing Up into Engagement with Speedmech Swingarm and Continuing to Drive Pick Tire. | Loadstop Moving to "Load" Position. Loadstop Link Actuating Speedmech Lock Lever. | REV | IDLE | Media Page 2 Deskewed at Pinch Rollers. |
| PAGE 2 (FEED & EJECT) | Speedmech Shift Out [FIGS. 14A and 14B] | Pick Swingarm Held Up and in Neutral Position by Speedmech Swingarm. Speedmech Swingarm "Locked" Up by Speedmech Lock Lever. | Loadstop Link Un-actuating Speedmech Lock Lever and Allowing Speedmech Swingarm to be "Locked" Up. Loadstop Moving to "Gather" Position on its way to "Retract" Position. Action Occurs Underneath Loaded Media. | FWD | ENGAGED WITH SHIFTER. Action Causes Speedmech Swingarm to Rotate Up into "Locked" Position. | Media Moves Out to TOF Position. |
| | Print Eject [FIGS. 15A and 15B] | Pick Swingarm Disengaged with Idler Gear. | Loadstop Moving to "Gather" Position on its way to "Retract" Position. Action Occurs Underneath Loaded Media. | | PRINTING | Media Printed and Ejected. |
| PICK ARM LIFT | Pick-Arm Lifted [FIGS. 16A and 16B] | Pick Swingarm Reversing to Engage Pick-arm Lifter Crank and Raise Pick-arm. Speedmech Swingarm Released by Lock Lever and in "Unlocked" Position. | Loadstop Moving to "Load" Position. Loadstop Link Actuating Speedmech Lock Lever. | REV | CAPPED | Media Static in Input and Output Trays. |

FIGS. 7A and 7B illustrate one example of a Pick-Arm Lifted state of transmission system 400 during a Pick Arm Lifted operation. More specifically, FIGS. 7A and 7B illustrate transmission system 400 in a pick arm lifted "ready state" with no pages picked, including loadstop drive assembly 500 illustrated with loadstop paddle 522 in the "load" position, and loadstop link assembly 530 actuating speedmech lock lever assembly 560, and pick drive assembly 600 illustrated with pick swingarm assembly 610 engaged with lifter crank 638 in the "lifted" position, and speedmech swingarm assembly 620 "unlocked".

Figure 8A:
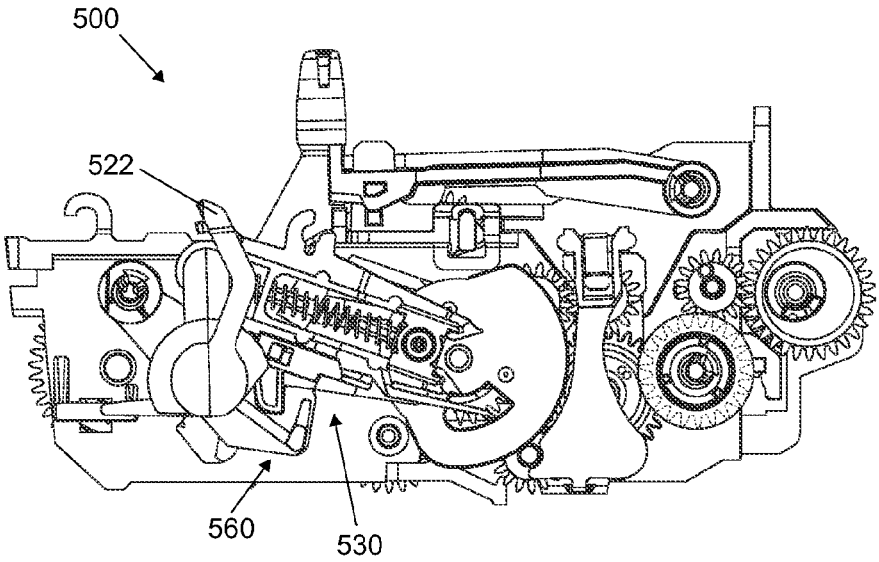
Figure 8B:
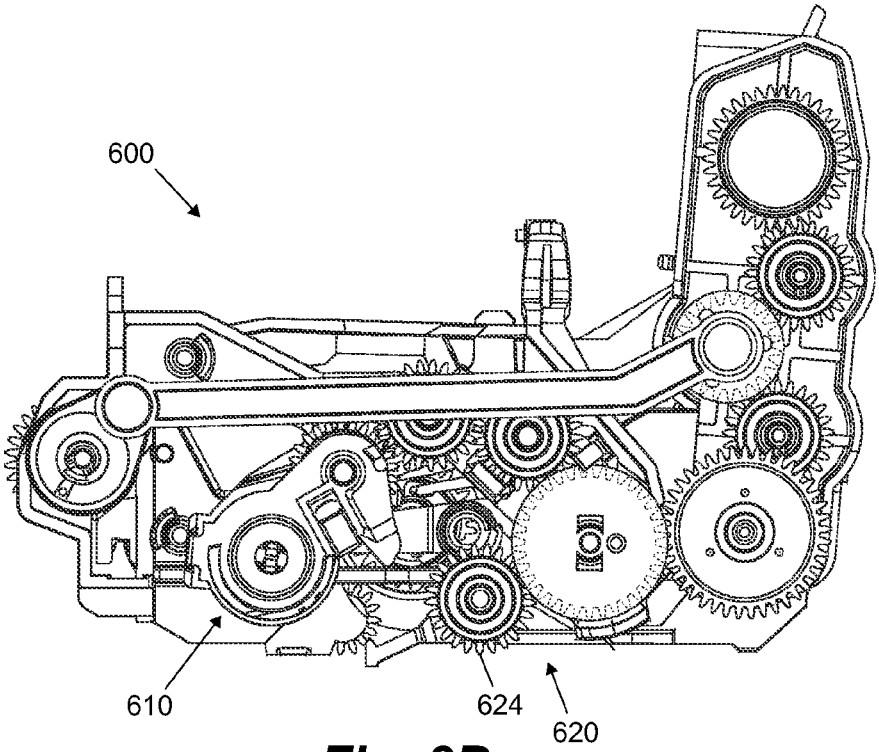

FIGS. 8A and 8B and 9A and 9B, 10A and 10B, and 11A and 11B illustrate one example of a Speedmech Pick Engaged state, a Speedmech Paper Active Deskew state, and a Print and Pick Clutching state, respectively, of transmission system 400 during a Page 1 (Load, Deskew & Feed) operation. More specifically, FIGS. 8A and 8B illustrate transmission system 400 in a pick arm lowered state with no pages picked or loaded (pick tire not yet turning), including loadstop drive assembly 500 illustrated with loadstop paddle 522 moving to the "gather" position on its way to the "retract" position, and speedmech lock lever assembly 560 un-actuated by loadstop link assembly 530, and pick drive assembly 600 illustrated with pick swingarm assembly 610 passing down under speedmech swingarm assembly 620 to engage with idler gear 624. This is a transitional state of both loadstop drive assembly 500 and pick drive assembly 600.

Figure 9A:
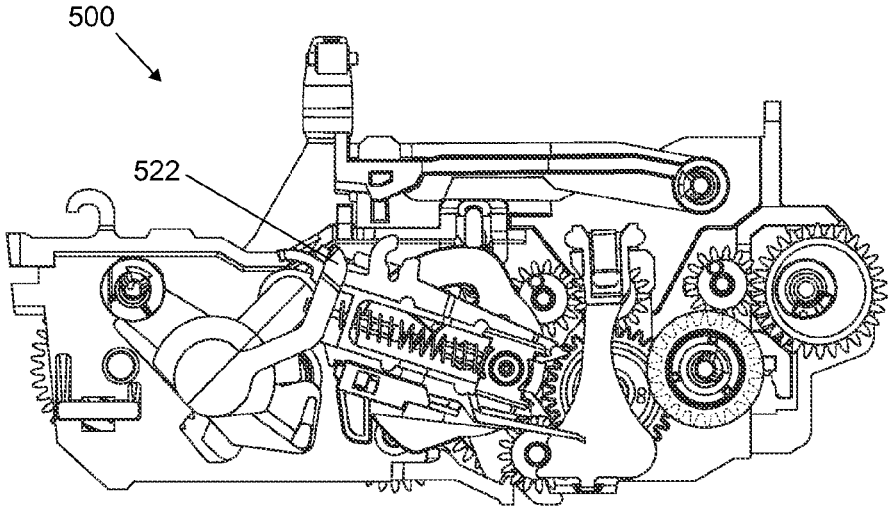
Figure 9B:
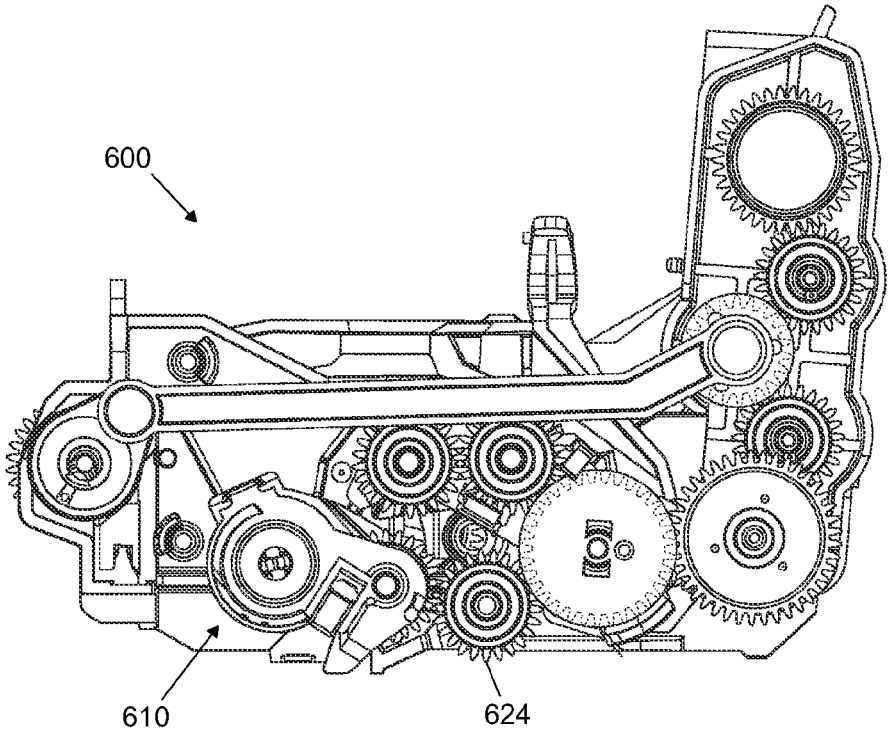

In addition, FIGS. 9A and 9B illustrate transmission system 400 as page 1 (of the 2 page job) is picked and separated with loadstop drive assembly 500 in a retracted state and pick drive assembly 600 in a speedmech engaged state, including loadstop drive assembly 500 illustrated with loadstop paddle 522 being static in the "retract" position, and pick drive assembly 600 illustrated with pick swingarm assembly 610 engaged with idler gear 624 and driving pick tires 634 (FIG. 6).

Figure 10A:
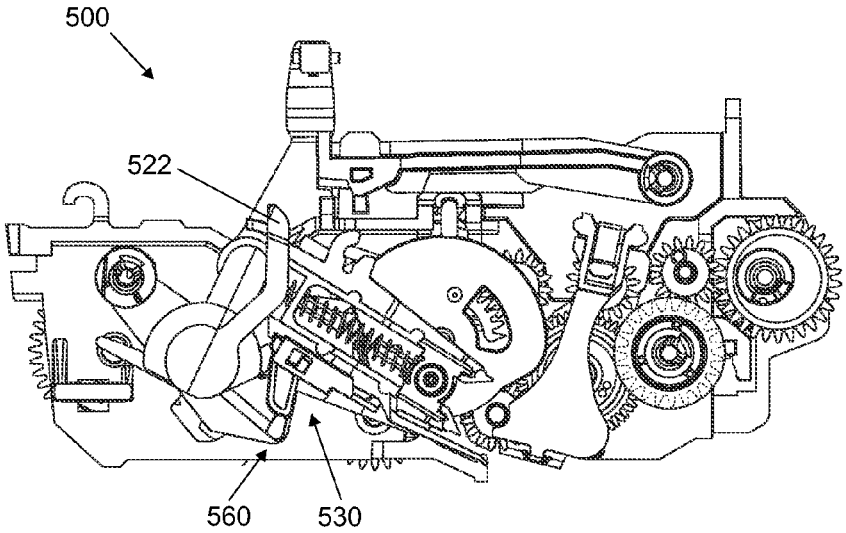
Figure 10B:
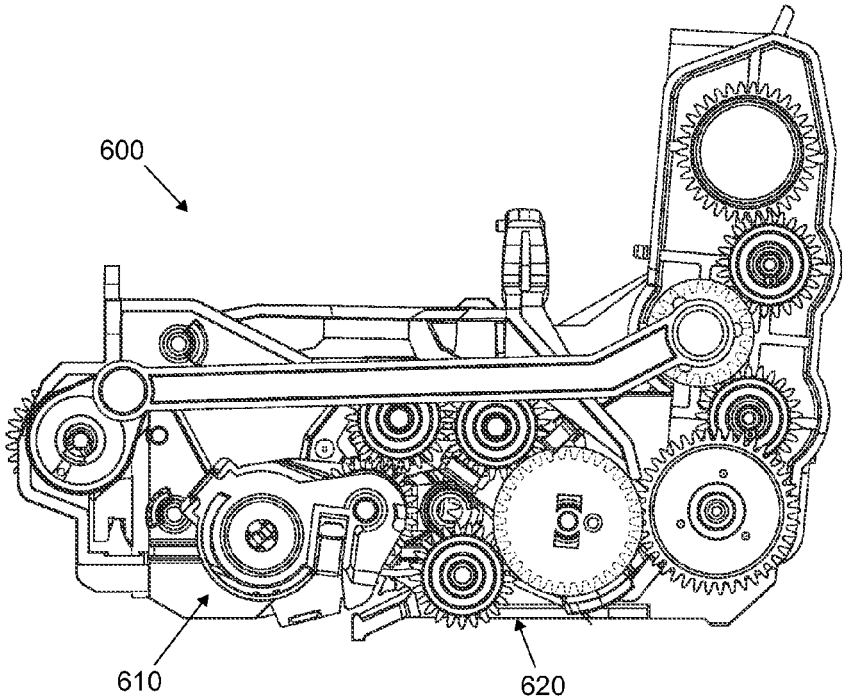

In addition, FIGS. 10A and 10B illustrate transmission system 400 as media is being loaded to the feedroller for "deskew" (the leading edge of the media is at the feedroller and the mid portion of the media is under the pick tire). This state shows loadstop paddle 522 back in a load state (under the media), including loadstop drive assembly 500 illustrated with loadstop paddle 522 moving to the "load" position, and loadstop link assembly 530 actuating speedmech lock lever assembly 560, and pick drive assembly 600 illustrated with pick swingarm assembly 610 reversing up into engagement with speedmech swingarm assembly 620 and continuing to drive pick tires 634 (FIG. 6).

Figure 11A:
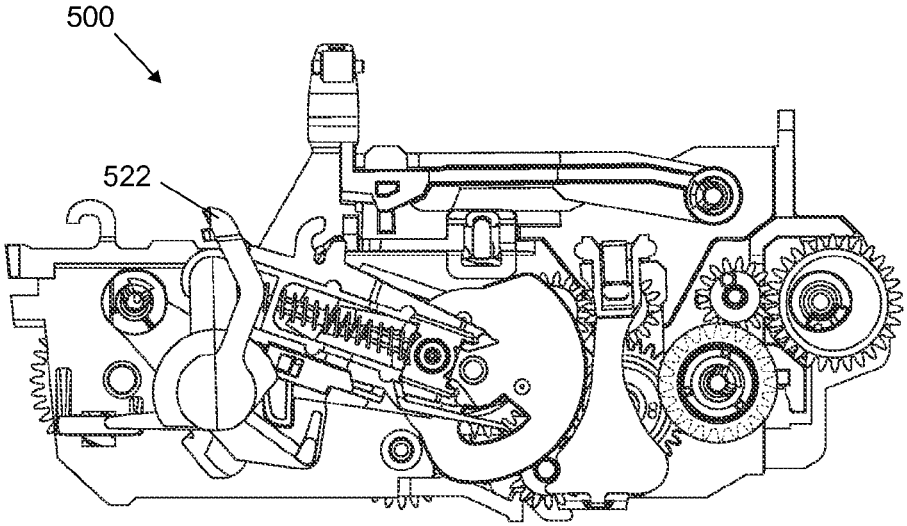
Figure 11B:
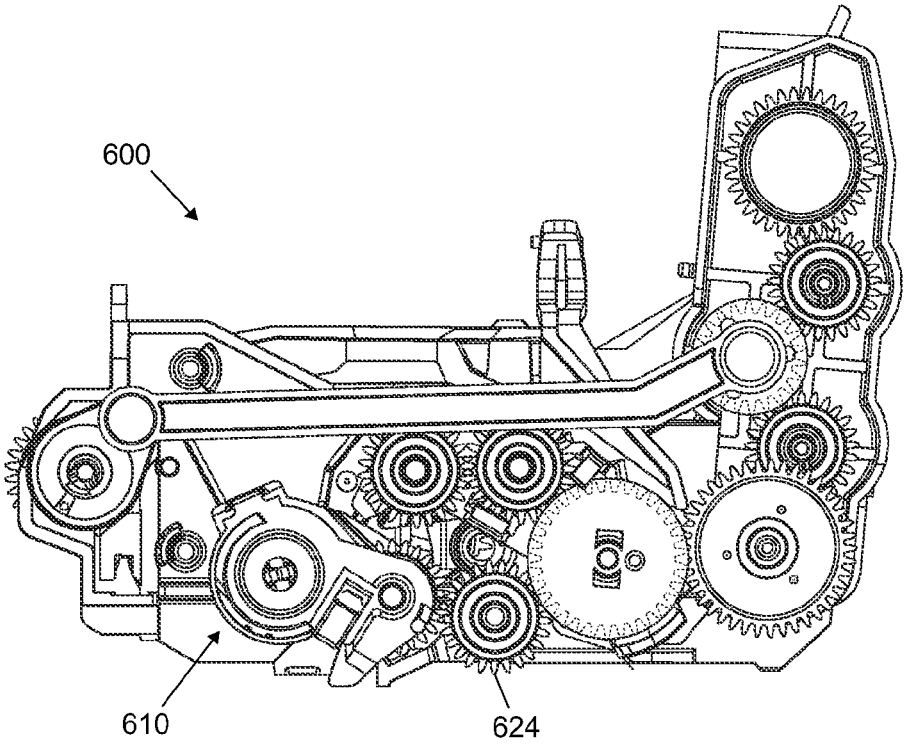

In addition, FIGS. 11A and 11B illustrate transmission system 400 as page 1 is starting to be printed (the top edge of the media is just past the feedroller) while page 2 has not yet been picked (the media is being gathered by the loadstop in the input tray), including loadstop drive assembly 500 illustrated with loadstop paddle 522 moving to the "gather" position on its way to the "retract" position (action occurs underneath loaded media), and pick drive assembly 600 illustrated with pick swingarm assembly 610 passing down and engaged with idler gear 624. Loadstop paddle 522 is gathering (under page 1) on its way to the "retract" position, and pick swingarm assembly 610 is driving pick tires 634 (FIG. 6).

Figure 12A:
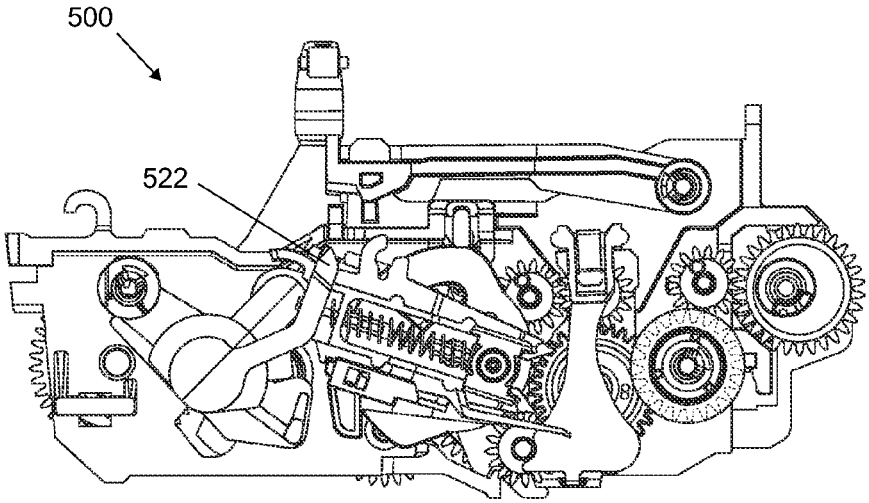
Figure 12B:
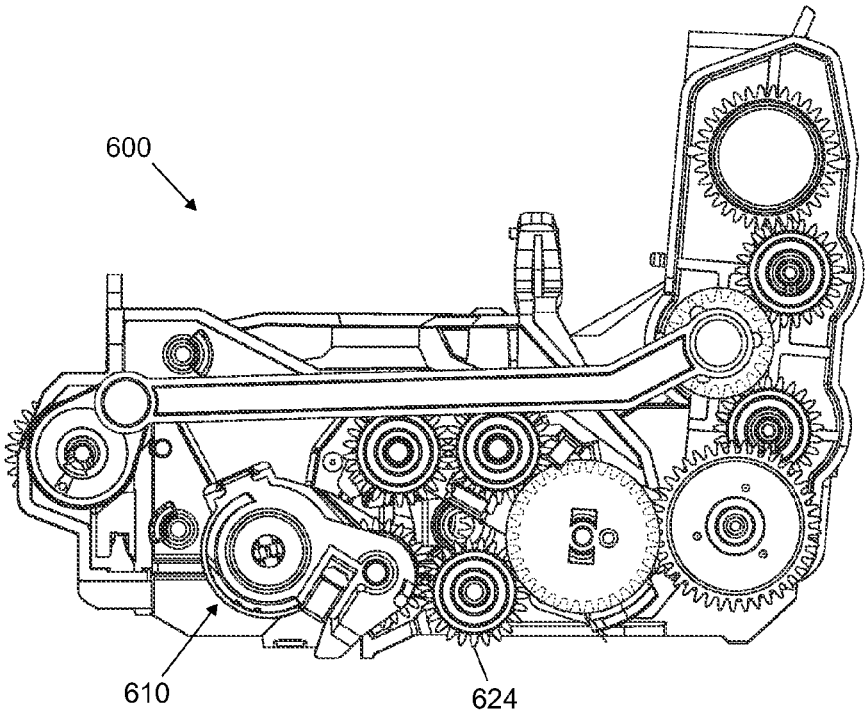

FIGS. 12A and 12B, and 13A and 13B illustrate one example of a Speedmech Picking state, and a Speedmech Paper Active Deskew state, respectively, of transmission system 400 during a Page 1 (Feed & Eject) Page 2 (Load & Deskew) operation. More specifically, FIGS. 12A and 12B illustrate transmission system 400 as page 1 is being printed while page 2 is being picked (the bottom edge of page 1 is just short of leaving the feedroller and the top edge of page 2 is picked past the loadstop), including loadstop drive assembly 500 illustrated with loadstop paddle 522 being static in the "retract" position, and pick drive assembly 600 illustrated with pick swingarm assembly 610 engaged with idler gear 624 and driving pick tires 634 (FIG. 6). In one implementation, the two pages (page 1, page 2) start to move together with an overlap, however, after the two pages move into the media path, a gap is eventually generated between the two pages by the speed ratio difference between the feedroller and the pick tire (i.e., page 2 is being picked, while page 1 is being fed).

Figure 13A:
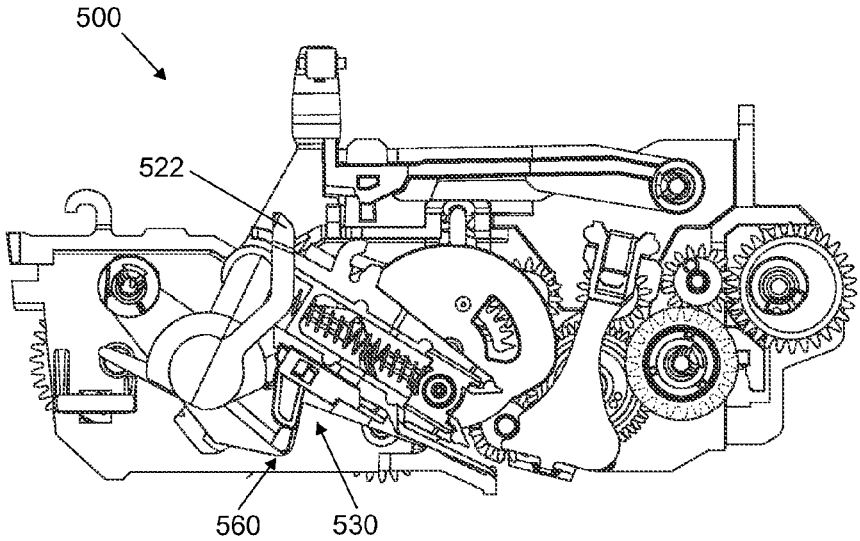
Figure 13B:
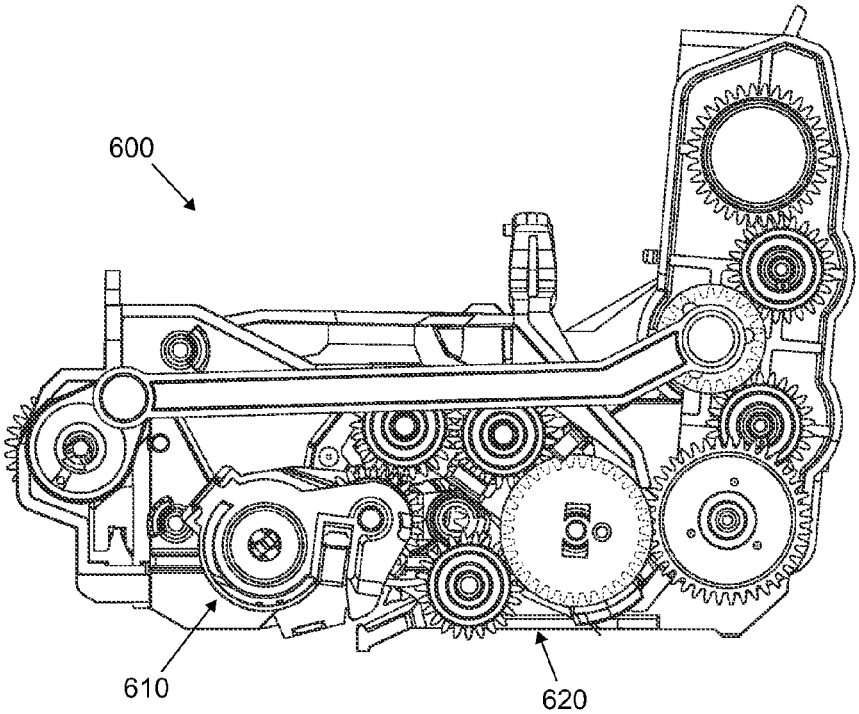

In addition, FIGS. 13A and 13B illustrate transmission system 400 as page 1 is being printed while page 2 is being deskewed (the bottom edge of page 1 is just past the feedroller and the top edge of page 2 is just entering the feedroller (with the gap still being between the two pages)), including loadstop drive assembly 500 illustrated with loadstop paddle 522 moving to the "load" position, and loadstop link assembly 530 actuating speedmech lock lever assembly 560, and pick drive assembly 600 illustrated with pick swingarm assembly 610 reversing up into engagement with speedmech swingarm assembly 620 and continuing to drive pick tires 634 (FIG. 6).

Figure 14A:
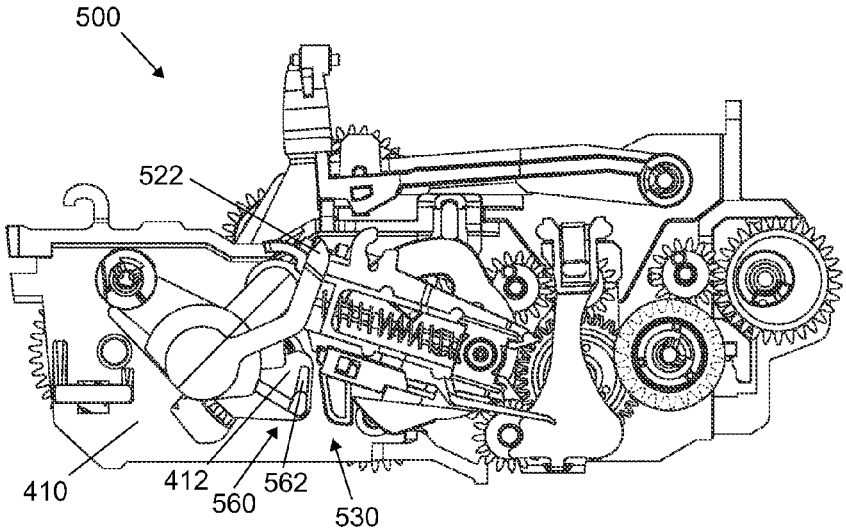
Figure 14B:
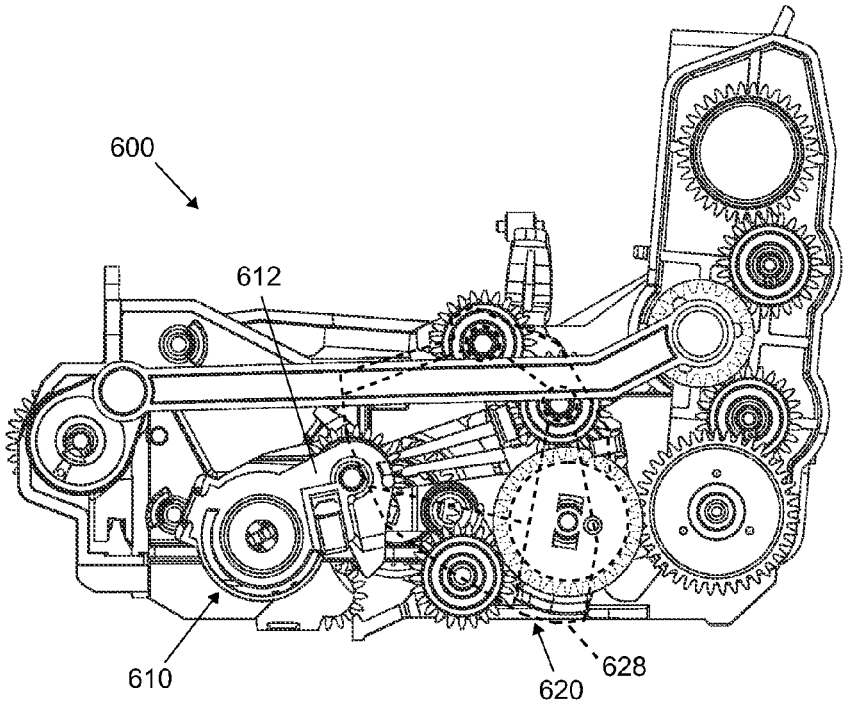

FIGS. 14A and 14B, and 15A and 15B illustrate one example of a Speedmech Shift Out state, and a Print Eject state, respectively, of transmission system 400 during a Page 2 (Feed & Eject) operation. More specifically, FIGS. 14A and 14B illustrate transmission system 400 in a "shift out" state (the print carriage engages the transmission in order to rotate the speedmech swingarm sufficiently to allow the speedmech swingarm to be "locked" by the lock lever), including loadstop drive assembly 500 illustrated with loadstop link assembly 530 un-actuating speedmech lock lever assembly 560 and allowing speedmech swingarm assembly 620 to be "locked" in an "up" position, and loadstop paddle 522 moving to the "gather" position on its way to the "retract" position (action occurs underneath loaded media), and pick drive assembly 600 illustrated with pick swingarm assembly 610 held up and in a "neutral" position by speedmech swingarm assembly 620, and speedmech swingarm assembly 620 "locked" in an "up" position by speedmech lock lever assembly 560. In one implementation, with loadstop link assembly 530 un-actuating (i.e., disengaged from) speedmech lock lever assembly 560, speedmech swingarm assembly 620 is held or "locked" in an "up" position by lock lever 562 of lock lever assembly 560 passing through an opening 412 in gear wall 410 and engaging speedmech swingarm assembly 620. In addition, in one implementation, pick swingarm assembly 610 is held up and in a "neutral" position by interaction between pick swingarm assembly 610 and speedmech swingarm assembly 620 (e.g., interaction or interference between swingarm retainer 628 (schematically illustrated in broken lines) of speedmech swingarm assembly 620 and swingarm retainer 612 of pick swingarm assembly 610).

Figure 15A:
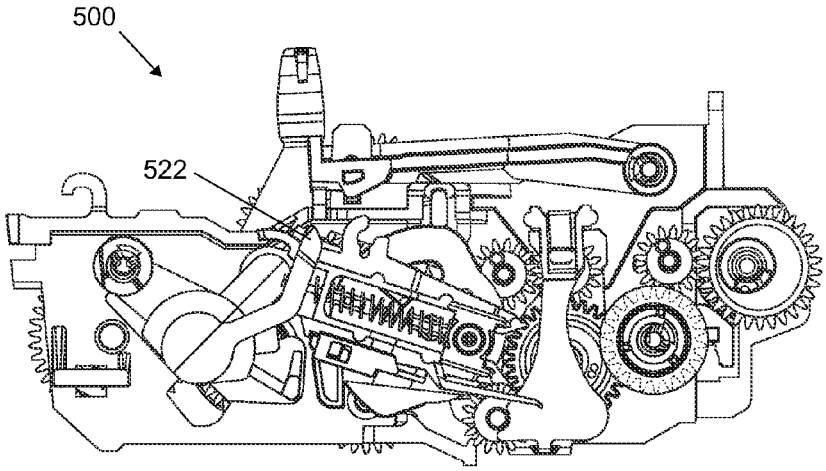
Figure 15B:
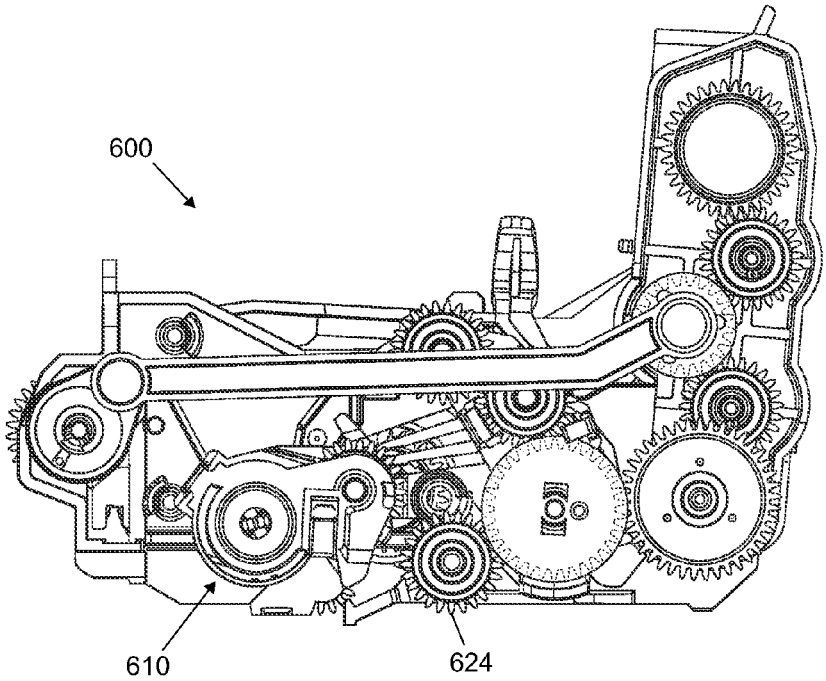

In addition, FIGS. 15A and 15B illustrate transmission system 400 in a pick tire/speedmech disengaged state where the speedmech swingarm is "locked" by the lock lever and the pick swingarm is prevented from engaging the pick transmission and driving the pick tires, including loadstop drive assembly 500 illustrated with loadstop paddle 522 moving to the "gather" position on its way to the "retract" position (action occurs underneath loaded media), and pick drive assembly 600 illustrated with pick swingarm assembly 610 disengaged from idler gear 624. In this state, page 1 has been ejected into the output tray and page 2 is printed (the bottom edge of page 2 is just short of leaving the feedroller and the remaining pages are unpicked in the input tray).

Figure 16A:
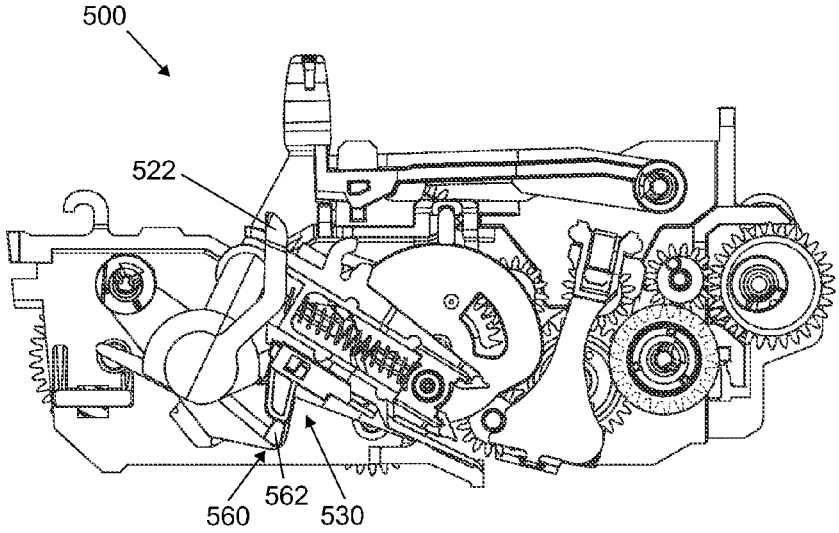
Figure 16B:
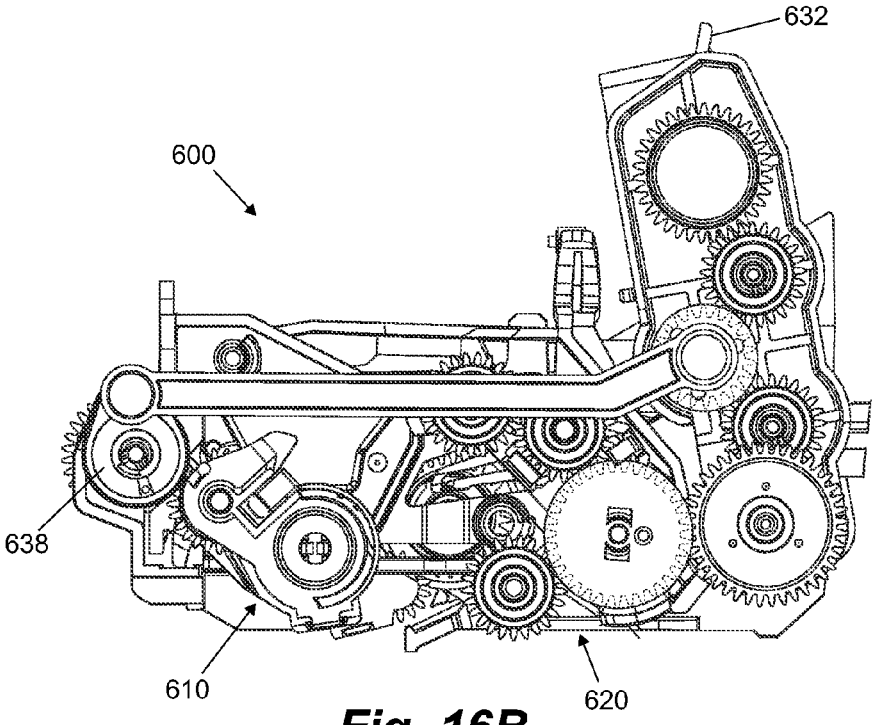

FIGS. 16A and 16B illustrate one example of a Pick-Arm Lifted state of transmission system 400 during a Pick Arm Lift operation. More specifically, FIGS. 16A and 16B illustrate transmission system 400 when all media has been ejected from the media path to the output tray, including loadstop drive assembly 500 illustrated with loadstop paddle 522 moving to the "load" position, and loadstop link assembly 530 actuating speedmech lock lever assembly 560, and pick drive assembly 600 illustrated with pick swingarm assembly 610 reversing to engage pick-arm lifter crank 638 and raise pick-arm 632, and speedmech swingarm assembly 620 released by speedmech lock lever assembly 560 and in an "unlocked" position. Speedmech swingarm assembly 620 was "unlocked" by speedmech lock lever assembly 560 when loadstop link assembly 530 actuated lock lever 562 while going from the "retract" position to the "load" position, and pick swingarm assembly 610 returned to lifter crank 638 to lift pick arm 632.

Figure 17A:
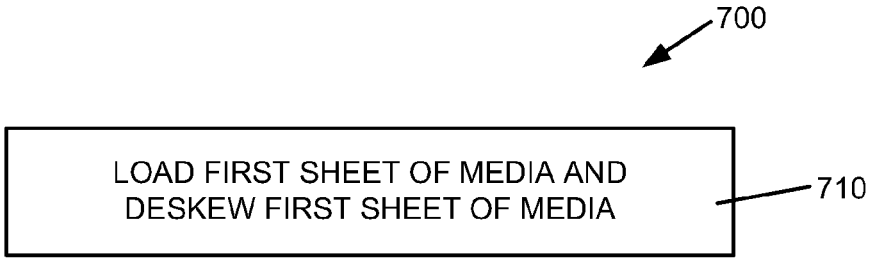
FIGS. 17A, 17B, and 17C are flow diagrams illustrating one example of a method of transporting media in a printing system.
Figure 17B:
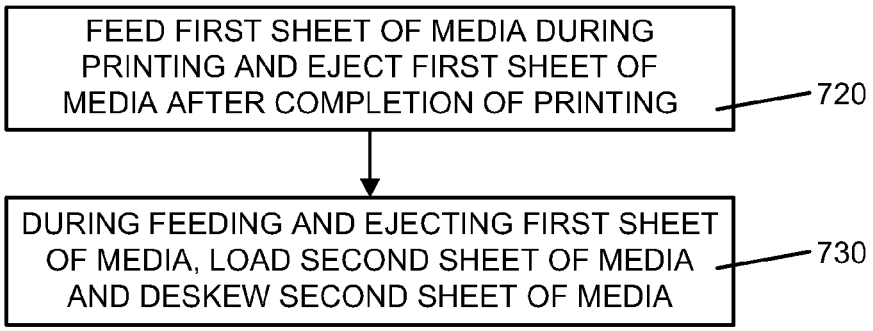
Figure 17C:
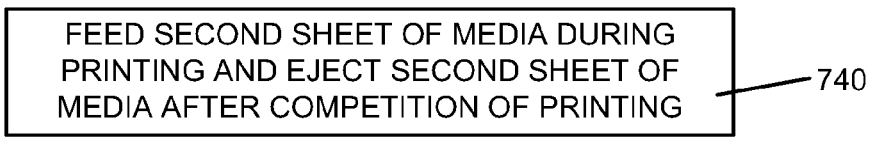

FIGS. 17A, 17B, and 17C are flow diagrams illustrating one example of a method 700 of transporting media in a printing system, such as printing system 200. More specifically, method 700 represents one example of transporting media using loadstop drive assembly 500 and pick drive assembly 600.

With reference to FIG. 17A, at 710, a first sheet of media is loaded and deskewed. In one implementation, loading and deskewing the first sheet of media is performed with loadstop drive assembly 500 and pick drive assembly 600 in the states illustrated in FIGS. 8A and 8B-FIGS. 11A and 11B.

With reference to FIG. 17B, at 720, the first sheet of media is fed during printing and ejected after completion of the printing, and at 730, a second sheet of media is loaded and deskewed during the feeding and the ejecting of the first sheet of media. In one implementation, feeding the first sheet of media during printing and ejecting the first sheet of media after completion of the printing, and loading and deskewing the second sheet of media during the feeding and the ejecting of the first sheet of media is performed with loadstop drive assembly 500 and pick drive assembly 600 in the states illustrated in FIGS. 12A and 12B, and FIGS. 13A and 13B.

With reference to FIG. 17C, at 740, the second sheet of media is fed during printing and ejected after completion of the printing. In one implementation, feeding the second sheet of media during printing and ejecting the second sheet of media after completion of the printing is performed with loadstop drive assembly 500 and pick drive assembly 600 in the states illustrated in FIGS. 14A and 14B, and FIGS. 15A and 15B.

With transmission system 400, as described herein, loadstop drive assembly 500 is designed to actuate loadstop with a short cycle time to enable short pick cycles, and is designed to work in sequence with pick drive assembly 600 by locking and unlocking speedmech swingarm at the appropriate times. In addition, pick drive assembly 600 is designed to provide "gathering" loadstop functionality between pages (e.g., between every page) of a speedmech print job for pick reliability. Speedmech in general is designed to increase throughput by overlapping picking and printing, thus minimizing the media load impact on ISO print speed performance. Also with ISO print speed and FPO (First Page Out) performance in mind, pick drive assembly 600 is designed to have a short speedmech shift-out duration, and is designed to work with a low force carriage system when shifting and an overall low power system. Furthermore, pick mechanism 630 is designed to be a robust, reliable, maximum height pick arm lifting mechanism, and is designed to improve acoustics by allowing a controlled speed lowering at the start of a print job and a controlled speed lift at the end of a print job.

Transmission system 400, as described herein, allows media to be picked and separated from the media stack in parallel with print linefeed advances (aka: speedmeching). Transmission system 400 also reduces an effective media load path length of subsequent pages (by approximately half) in a multi-page job by picking those pages into the media path while printing of the previous page is occurring. The result is a reduction in pick cycle duration between printed pages and thus an increase in performance.

Transmission system 400, as described herein, provides for increased ISO speeds (speedmech), and helps to maintain pick reliability by "tidying" the input media stack between pages (e.g., between every page). In addition, transmission system 400 provides for improved ease of loading single sheets or small stacks of media (improved pick arm lift), and may enable full bleed output system (borderless printing). In addition, transmission system 400 provides for improved acoustics of picking, and pick arm lift and lower. Furthermore, transmission system 400 provides a reliable and low cost system, while operating with the low torque available from paper and carriage motors.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

What is claimed is:

1. A media transport assembly, comprising:

a loadstop drive assembly to gather and compress a media stack in a media tray before a pick and feed cycle; and a pick drive assembly to pick a sheet of media from the media stack and feed the sheet of media to a media path, the loadstop drive assembly positioned on one side of a gear wall and the pick drive assembly positioned on an opposite side of the gear wall, the pick drive assembly driven by the loadstop drive assembly through the gear wall, the pick drive assembly including a pick swingarm assembly to actuate a pick arm and a speedmech swingarm assembly engaged with the pick swingarm assembly to drive a plurality of pick tires in one direction with rotational input to the speedmech swingarm assembly of both a first direction and a second direction opposite the first direction.

2. The assembly of claim 1, wherein the loadstop drive assembly comprises:

a loadstop paddle moveable between a load position to limit an amount of media in the media tray, a retracted position to allow media to pass to the media path, and a gather position during transition between the load position and the retracted position to gather and compress media in the media tray.

3. The assembly of claim 2, wherein the loadstop drive assembly further comprises:

a loadstop link assembly to move the loadstop paddle between the load position, the retracted position, and the gather position;

a cam gear assembly to actuate the loadstop link assembly; and a loadstop swingarm assembly to drive the cam gear assembly, the loadstop swingarm assembly including first and second idler gears each selectively engaged with the cam gear assembly to drive the cam gear assembly in one direction with rotational input to the loadstop swingarm assembly of both a first direction and a second direction opposite the first direction.

4. The assembly of claim 3, wherein the pick drive assembly comprises:

a pick mechanism including the plurality of pick tires supported by the pick arm to contact and pick a sheet of media from the media stack;

the pick swingarm assembly to actuate the pick arm of the pick mechanism; and the speedmech swingarm assembly to drive the pick tires of the pick mechanism, the speedmech swingarm assembly including first and second idler gears each selectively engaged with a gear of the pick swingarm assembly to drive the pick tires in the one direction with rotational input to the speedmech swingarm assembly of both the first direction and the second direction opposite the first direction.

5. The assembly of claim 4, wherein the loadstop drive assembly further comprises:

a speedmech lock lever assembly selectively engaged by the loadstop link assembly of the loadstop drive to lock and unlock the speedmech swingarm assembly of the pick drive assembly through the gear wall.

6. The assembly of claim 4, wherein the pick mechanism further includes:

a pick arm lifter link operatively connected to the pick arm, and a pick arm lifter crank operatively connected to the pick arm lifter link, the pick arm lifter crank selectively engaged by the gear of the pick swingarm assembly to actuate the pick arm lifter link to raise and lower the pick arm relative to the media stack.

7. A media transport assembly, comprising:

a loadstop swingarm assembly to drive a cam gear assembly and actuate a loadstop link assembly to move a loadstop paddle between a load position to limit media in a media tray, a retracted position to allow media in a media path, and a gather position during transition between the load position and the retracted position to gather and compress media in the media tray;

a speedmech swingarm assembly to drive a plurality of pick tires of a pick mechanism; and a pick swingarm assembly to actuate a pick arm of the pick mechanism, the loadstop swingarm assembly to transmit rotational input of first and second opposite directions to the cam gear assembly to drive the cam gear assembly in one direction, and the pick swingarm assembly to transmit the rotational input of the first and second opposite directions from the loadstop swingarm assembly to the pick tires through the speedmech swingarm assembly to drive the pick tires in the one direction.

8. The assembly of claim 7, further comprising:

a first idler gear of the loadstop swingarm assembly to engage the cam gear assembly and transmit the rotational input of the first direction to the cam gear assembly to drive the cam gear assembly in the one direction; and a second idler gear of the loadstop swingarm assembly to engage the cam gear assembly and transmit the rotational input of the second direction to the cam gear assembly to drive the cam gear assembly in the one direction.

9. The assembly of claim 7, further comprising:

a gear of the pick arm assembly to engage a first idler gear of the speedmech swingarm assembly to transmit the rotational input of the first direction from the loadstop swingarm assembly to the pick tires through the speedmech swingarm assembly to drive the pick tires in the one direction; and a second idler gear of the speedmech swingarm assembly to engage the gear of the pick swingarm assembly to transmit the rotational input of the second direction from the loadstop swingarm assembly through the speedmech swingarm assembly to the pick tires to drive the pick tires in the one direction.

* * * * *